US005171121A

United States Patent [19]

Smith et al.

[11] Patent Number: 5,171,121

[45] Date of Patent: Dec. 15, 1992

[54] PORTABLE CONCRETE BATCH PLANT

[75] Inventors: Neil C. Smith, Fremont; Donald L. Hansen; Gary Tuma, both of Blair, all of Nebr.

[73] Assignee: Concrete Equipment Company, Blair, Nebr.

[21] Appl. No.: 817,699

[22] Filed: Jan. 7, 1992

[51] Int. Cl.[5] ..... B28C 9/04

[52] U.S. Cl. ..... 414/332; 414/21; 414/919; 366/30; 366/33

[58] Field of Search ..... 366/8, 16, 20, 27, 30, 366/33, 35, 38, 42, 50, 181, 186, 189; 414/21, 332, 919

[56] References Cited

U.S. PATENT DOCUMENTS

| | | | |
|---|---|---|---|
| 2,748,918 | 6/1956 | Mercier | 366/16 X |
| 3,064,832 | 11/1962 | Heltzel | 414/332 |
| 3,154,202 | 10/1964 | Heltzel | 414/332 |
| 3,251,484 | 5/1966 | De P. Hagan | 414/21 |
| 3,295,698 | 1/1967 | Ross et al. | 366/186 X |
| 3,406,839 | 10/1968 | Heltzel | 414/21 |
| 3,476,270 | 11/1969 | Cox et al. | 414/21 |
| 3,998,436 | 12/1976 | Allen et al. | 414/21 X |
| 4,178,117 | 12/1979 | Brugler | 414/21 |
| 4,579,496 | 4/1986 | Gerlach | 414/21 |

FOREIGN PATENT DOCUMENTS 3731623 3/1989 Fed. Rep. of Germany ..... 366/42

*Primary Examiner*—Harvey C. Hornsby
*Assistant Examiner*—C. Cooley
*Attorney, Agent, or Firm*—Zarley, McKee, Thomte, Voorhees & Sease

[57] ABSTRACT

A portable concrete batch plant which may be pulled from one location to another and which may be used either as a transit mix batch plant or a central mix batch plant. The batch plant is mounted on a wheeled frame comprised of a rear frame section and a front frame section removeably secured thereto. The batch plant is transported from one location to another with the rear and front frame sections connected together. If the batch plant is desired to be used as a transit mix plant, the front and rear frame sections remain connected together. If it is desired to use the concrete batch plant as a central mix batch plant, the front and rear frame sections are separated with the front frame section being spaced horizontally and vertically from the rear frame section with an extension conveyor being positioned there between.

1 Claim, 3 Drawing Sheets

PORTABLE CONCRETE BATCH PLANT

BACKGROUND OF THE INVENTION

This invention relates to a concrete batch plant and more particularly to a portable concrete batch plant which may be used either as a transit mix batch plant or a central mix batch plant.

Concrete batch plants are used to produce concrete and are either of the stationary type or of the portable type. The separate components of a stationary concrete batch plant are normally transported to the job site by means of flatbed trucks and are erected at the site by means of a crane or the like. The conventional concrete batch plants, whether they are of the stationary type or of the portable type, are either erected as a transit mix batch plant or a central mix batch plant. When the concrete batch plant is set up as a transit mix plant, the ingredients of the concrete are discharged from the plant into a transit mix truck with the ingredients being mixed by the transit mix truck between the plant and the location where the concrete is to be poured. In a central mix batch plant, the ingredients of the concrete are discharged from the plant into an elevated mixing drum so that the concrete may be mixed prior to being discharged into a non-transit mix truck. Thus, when a concrete batch plant is used as a central mix plant, the discharge end of the batch plant must be positioned sufficiently high enough so as to be able to discharge the concrete ingredients into the elevated central mixing drum.

Portable concrete batch plants are normally mounted on a wheeled frame means which is adapted to be pulled by a truck from one location to another. The portable batch plant, when in the transport mode, must have a maximum height which will permit the plant to pass beneath bridges, overpasses, etc. When the portable batch plant arrives at the job site, the discharge end of the plant must normally be raised somewhat to permit the truck charging chute to be at a height sufficient to permit a transit mix truck to be positioned therebelow. If the batch plant is to be used as a central mix batch plant, the entire plant must be elevated sufficiently to accommodate the central mix drum as previously described. Thus, the conventional portable concrete batch plant cannot be operated as a transit mix plant and a central mix plant without expensive modification thereof.

It is therefore a principal object of the invention to provide a portable concrete batch plant which may be easily modified so as to be either a transit mix plant or a central mix plant.

Yet another object of the invention is to provide a portable concrete batch plant which may be used as either a transit mix batch plant or a central mix batch plant but which still has a maximum height which permits it to be transported from one location to another.

Still another object of the invention is to provide a portable concrete batch plant which does not require extensive modification in order for the plant to be used as either a central mix plant or a transit mix plant.

These and other objects will be apparent to those skilled in the art.

SUMMARY OF THE INVENTION

The concrete batch plant of this invention is mounted on a wheeled frame means which may be pulled from one location to another by a prime mover such as a truck or the like. The wheeled frame means comprises a rear frame section having an aggregate batcher thereon which weighs the aggregate and deposits the same on a first aggregate conveyor which extends upwardly and forwardly from the lower end thereof. A front frame section is removably secured to the forward end of the rear frame section and has a second aggregate conveyor positioned thereon which extends upwardly and forwardly from the rear end of the front frame section toward the forward end of the front frame section. The rearward end of the second aggregate conveyor is in communication with the forward end of the first aggregate conveyor so that the aggregate may be conveyed to the discharge end of the batch plant. A cement storage hopper or tank is positioned on the front frame section, above the second aggregate conveyor, and has feeder screws extending therefrom which convey the cement upwardly and forwardly to a cement batcher located at the upper forward end of the front frame section. The cement batcher has a discharge end located adjacent the discharge end of the aggregate conveyor so that the aggregate and cement may be discharged from the plant. Water is also delivered to the discharge end of the batch plant.

When the batch plant is being used as a transit mix plant, the aggregate, cement and water are discharged into a transmit mix truck in conventional fashion. When the plant is to be used as a central mix plant, the front frame section is disconnected from the rear frame section with the front frame section being moved horizontally and elevated vertically so that the discharge end of the batch plant will be located a sufficient distance above the ground to permit the aggregate, cement and water to be discharged into an elevated central mix drum. An auxiliary conveyor section is installed between the forward end of the first aggregate conveyor and the rearward end of the second aggregate conveyor.

DESCRIPTION OF THE PREFERRED EMBODIMENT

Figure 1:
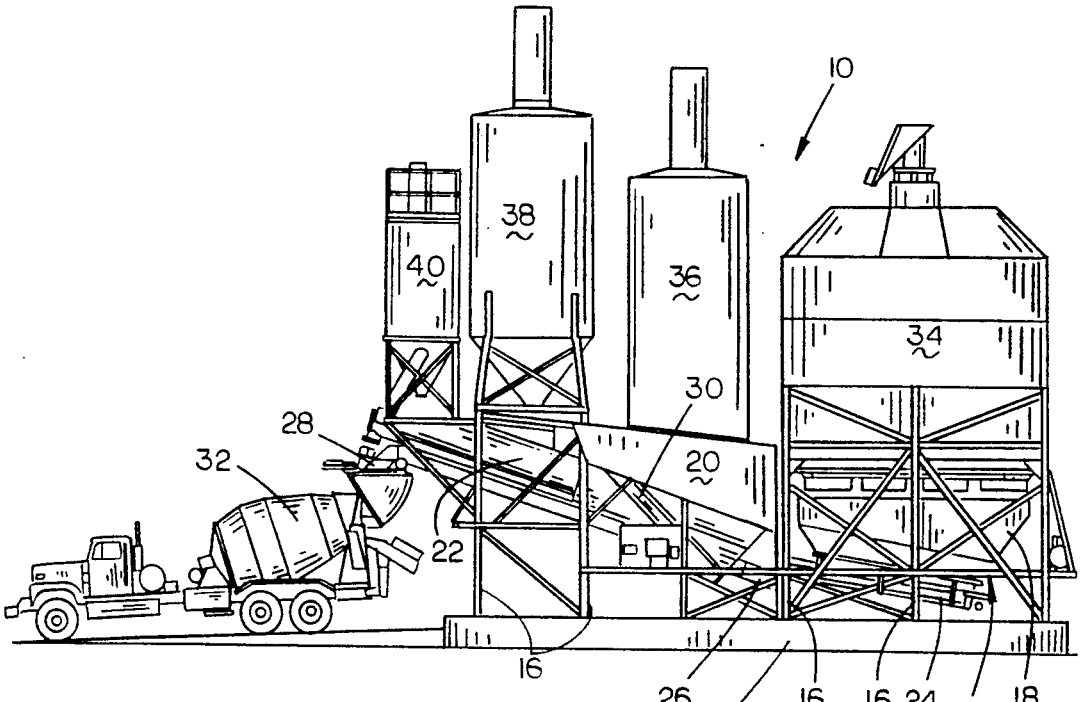
FIG. 1 (PRIOR ART)
FIG. 1 is a side view illustrating a conventional portable batch plant which has been positioned on a suitable footing at a job site and which is being used as a transit mix plant.

FIG. 1 illustrates a conventional portable concrete batch plant which has been erected at a job site so as to be used as a transit mix batch plant. The batch plant 10 in FIG. 1 includes a frame means 12 which would normally be wheel supported. The plant 10 has been positioned on a footing 14 so as to stabilizc the plant. Removable supporting legs 16 have also been installed on the lower end of the frame means 12 to stabilize the same.

Batch plant 10 includes an aggregate batcher 18, cement storage tank or hopper 20 and cement batcher 22. An inclined aggregate conveyor 24 is positioned beneath the aggregate batcher 18 and conveys the aggregate deposited thereon by the batcher 18 upwardly and forwardly therefrom. Aggregate conveyor 26 is positioned beneath cement storage hopper 20 and cement batcher 22 and has its rearward end in communication with the forward end of aggregate conveyor 24 so that the aggregate will be conveyed upwardly and forwardly to the discharge end 28 of the plant.

Feeder screws 30 are in communication with the cement storage hopper 20 and convey the cement upwardly and forwardly to the cement batcher 22. The cement batcher 22 discharges the cement therefrom at the discharge end 28. Water would also be discharged at discharge end 28 so that the transit mix truck 32 can mix the aggregate, cement and water between the plant and the job location. For convenience, an aggregate storage tank 34 is normally positioned above aggregate batcher 18 and a cement storage tank 36 is positioned above the cement storage hopper 20. Further, a cement storage tank 38 may be positioned above the cement batcher 22. The numeral 40 refers generally to a dust collection unit at the upper forward end of the batch plant.

The batch plant 10 of FIG. 1 may be used as a transit mix batch plant as illustrated in FIG. 1. If the batch plant is required to be used as a central mix batch plant, the entire plant 10 would have to be elevated above the footing 14 a sufficient distance so that the discharge end of the batch plant could discharge into the elevated central mix drum. Thus, it would be necessary for a crane or the like to be employed to elevate the batch plant 10 so that it could be used as a central mix plant. The elevated batch plant would have to be suitably supported on a frame structure or the like.

Figure 2:
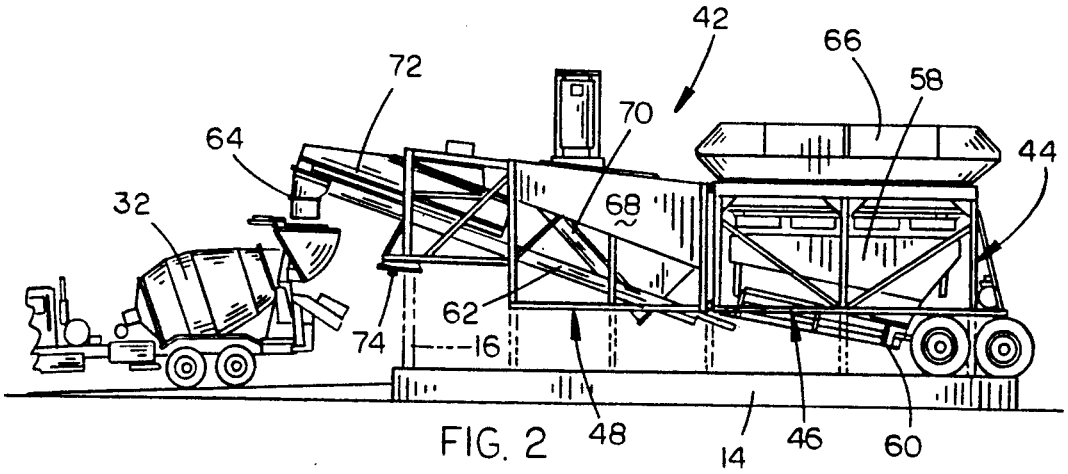
FIG. 2 is a side view of the portable concrete batch plant of this invention illustrating the same being used as a transit mix batch plant.
Figure 3:
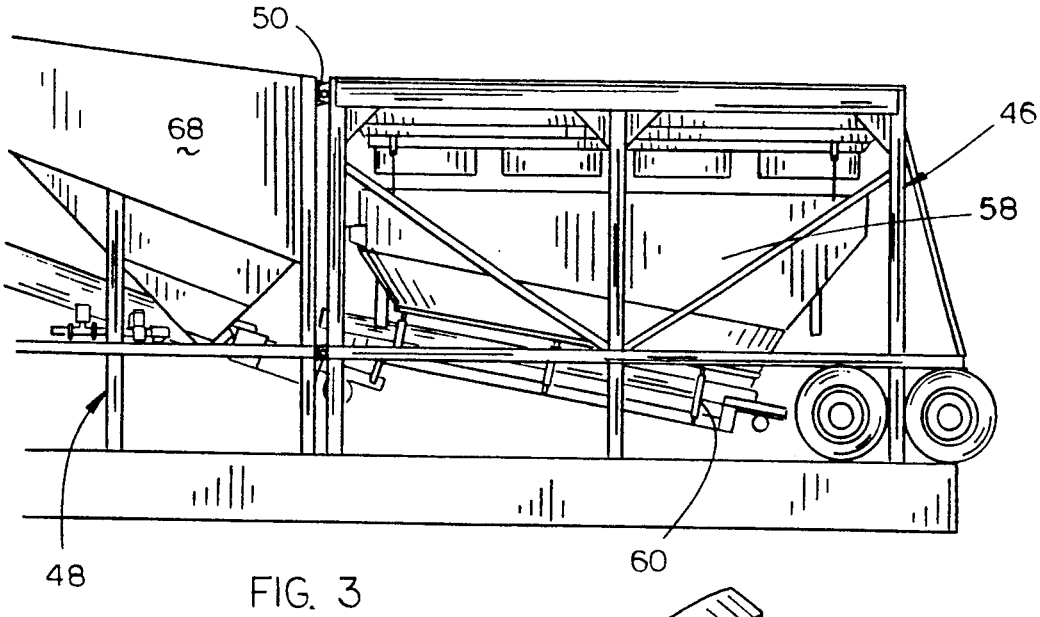
FIG. 3 is a partial side view similar to that of FIG. 2.
Figure 4:
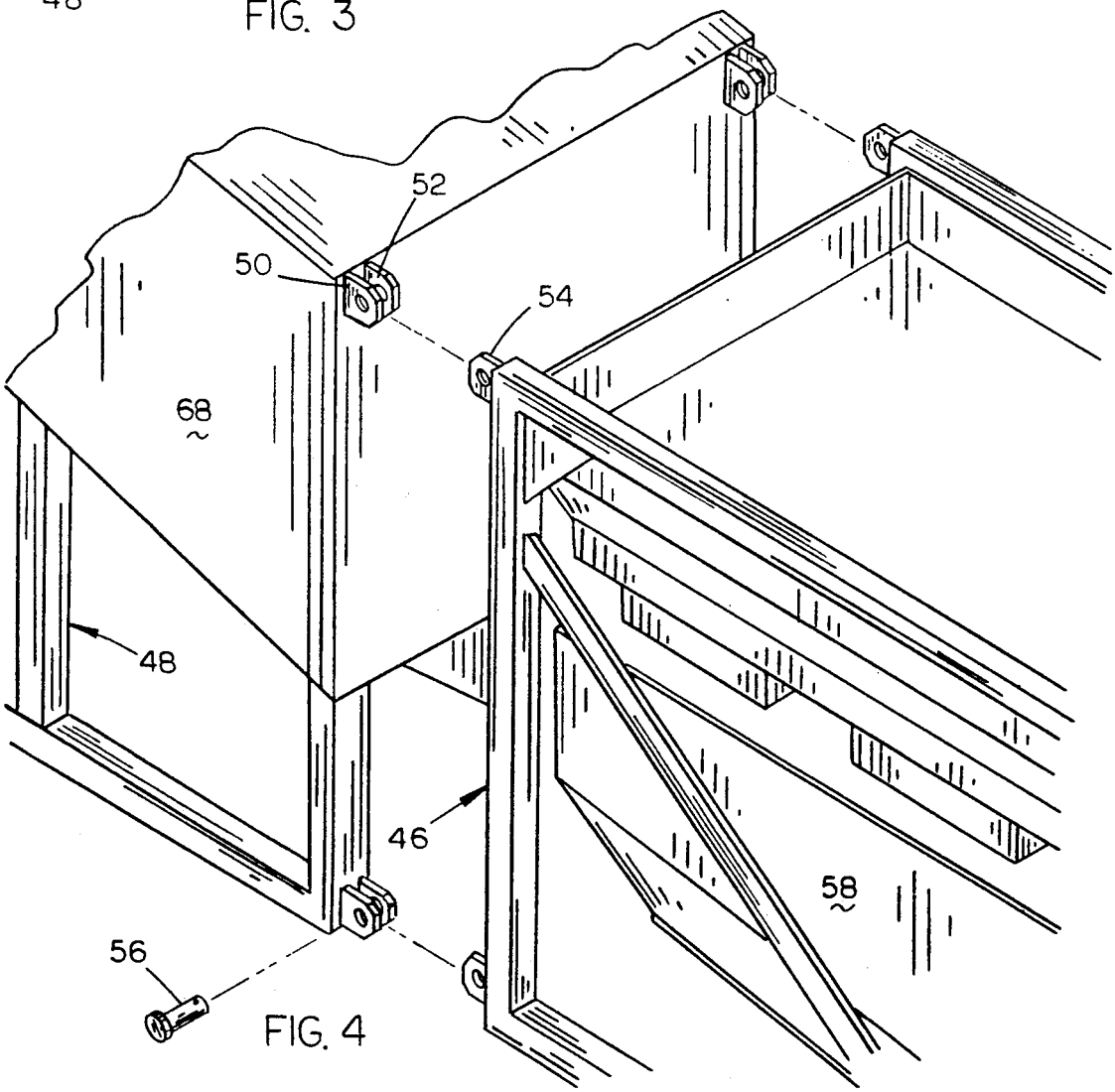
FIG. 4 is a partial perspective view illustrating the manner in which the batch plant may be separated to enable the batch plant to be converted from a transit mix batch plant to a central mix batch plant.
Figure 5:
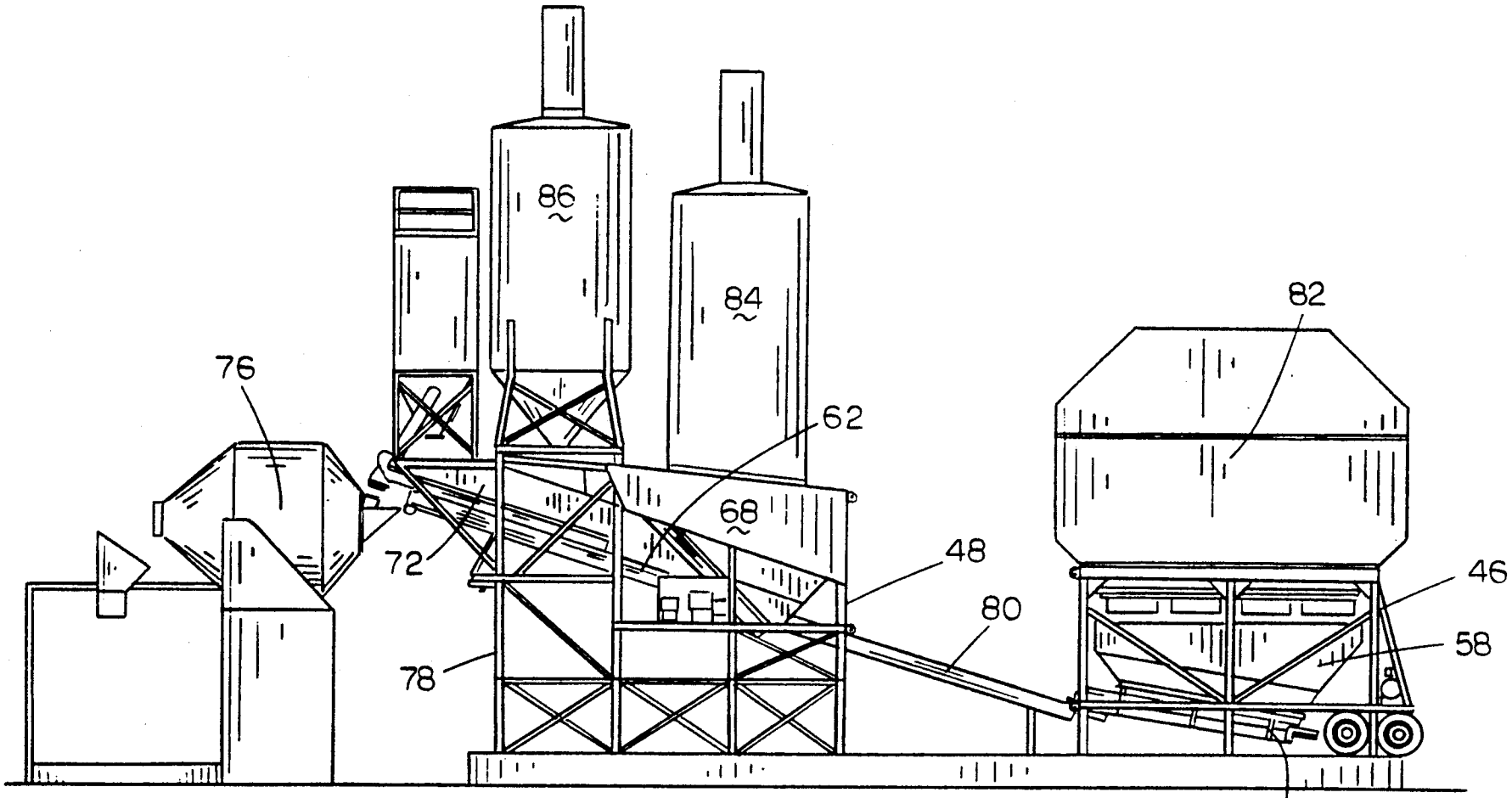
FIG. 5 is a side view illustrating the batch plant of this invention being used as a central mix batch plant.

Applicants' portable concrete batch plant illustrated in FIGS. 2–5 may be used as either a transit mix batch plant as illustrated in FIG. 2 or as a central mix batch plant as illustrated in FIG. 5. Applicants' batch plant is referred to generally by the reference numeral 42 and also includes a wheeled frame means similar to that of FIG. 1 and which is referred to by the reference numeral 44. Wheeled frame means 44 includes a wheeled rear frame section 46 and a non-wheeled front frame section 48 which are removably connected together as illustrated in FIG. 4 to permit the separation of the same when the plant 42 is to be used as a central mix concrete batch plant. As seen in FIG. 4, front frame section 48 includes rearwardly extending plates 50 and 52 at each of its four corners which are adapted to receive a forwardly extending plate 54 which is maintained therein by means of the pin 56 to prevent relative movement between the rear and front frame sections.

Batch plant 42 is conventional in that it includes an aggregate batcher 58 having an aggregate conveyor 60 positioned therebelow which extends upwardly and forwardly therefrom. The forward end of aggregate conveyor 60 is in communication with the rearward end of an aggregate conveyor 62 which is positioned on the front frame section 48. Aggregate conveyor 62 conveys the aggregate from batcher 58 upwardly and forwardly to the discharge spout 64. If desired, an auxiliary hopper or storage tank 66 may be positioned above the batcher 58.

A cement storage tank or hopper 68 is positioned on front frame section 48 and has one or more feeder screws 70 in communication therewith which convey the cement upwardly and forwardly to the cement batcher 72. Cement batcher 72 is designed to deliver the cement to the discharge spout 64 so that the cement and aggregate may be delivered to the transit mix truck 32.

Thus, when front section 48 is pinned to rear section 46, the plant 42 may be pulled from one location to another by means of a truck or the like since the front frame section 48 has a kingpin arrangement 74 positioned at the forward end thereof. When the plant 42 is to be used as a transit mix plant as illustrated in FIG. 2, the plant 42 would normally be positioned on the footing 14 for stability purposes. A plurality of removable legs or supports 16 would be positioned as illustrated by broken lines in FIG. 2 to adequately support the plant 42.

If the plant 42 is desired to be used as a central mix plant, as illustrated in FIG. 5, so as to be able to supply the cement, aggregate and water to the central mix drum 76, the pins 56 are removed to permit the separation of front frame section 48 from rear frame section 46. When front section 48 has been disconnected from rear section 46, front section 48 is moved forwardly from rear section 46 and is elevated by means of an extension leg assembly 78. An auxiliary conveyor section 80 is installed between rear frame section 46 and front frame section 48, as seen in FIG. 5, so that the aggregate on aggregate conveyor 60 may be conveyed to the aggregate conveyor 62 on front frame section 48.

In FIG. 5, an auxiliary aggregate storage tank or hopper 82 is positioned above aggregate batcher 58. Cement storage tank 84 may be positioned above cement storage 68 if desired to provide additional storage. Similarly, an additional cement storage tank 86 may be positioned above the cement batcher 72 if desired.

Thus, it can be seen that a novel portable concrete batch plant has been provided which may be easily transported from one location to another and which may easily pass beneath bridges, overpasses, etc. Once at the job site, the portable concrete batch plant of this invention may be used as either a transit mix batch plant or as a central mix batch plant without extensive modification of the same. Thus, the concrete batch plant of this invention has great verstility and accomplishes at least all of its stated objectives.

That which is claimed is:

1. A portable concrete batch plant capable of being used as a transit mix concrete batch plant or as a central mix concrete batch plant comprising:

a frame means having rearward and forward ends, said frame means including a rear wheeled frame means having rearward and forward ends and a non-wheeled front frame means having rearward and forward ends, connection means for removably securing the rearward end of said front frame means to the forward end of said rear frame means to prevent relative movement therebetween, said front frame means having means thereon for connection to a truck, an aggregate batcher means on said rear frame means, a first aggregate conveyor positioned beneath said aggregate batcher means for conveying aggregate forwardly with respect to said rear frame means, said first aggregate conveyor having rearward and forward ends, a second aggregate conveyor on said front frame means for conveying aggregate forwardly and upwardly with respect to said front frame means, said second aggregate conveyor having rearward and forward ends, the forward end of said first aggregate conveyor being positioned adjacent the forward end of said rear frame means, the rearward end of said second aggregate conveyor being positioned adjacent the rearward end of said front frame means when the batch plant is being used as a transit mix concrete batch plant so as to receive aggregate from said first aggregate conveyor, a cement batcher on said front frame means above said second aggregate conveyor, a cement conveyor means on said front frame means in operative communication with said cement batcher means for conveying cement forwardly therefrom, said rear and front frame means being selectively secured together to permit the batch plant to be transported from one location to another when connected together and to permit the batch plant to operate as a transit mix plant when connected together, said selective securement of said rear and front frame means permitting said rear and front frame means to be horizontally and vertically separated to permit the batch plant to operate as a central mix plant, and an extension conveyor means for bridging the horizontal and vertical separation between the rear and front frame means to operatively interconnect the forward end of said first aggregate conveyor and the rearward end of said second aggregate conveyor when the batch plant is being operated as a central mix plant.

* * * * *